United States Patent [19]

Long

[11] 4,143,516

[45] Mar. 13, 1979

[54] AIR-WATER POWER GENERATOR

[76] Inventor: Aden B. Long, P. O. Box 221, Hamilton, Mont. 59840

[21] Appl. No.: 845,232

[22] Filed: Oct. 25, 1977

[51] Int. Cl.[2] ..... F01K 25/06

[52] U.S. Cl. ..... 60/649; 60/674

[58] Field of Search ..... 60/649, 673, 674

[56] References Cited

U.S. PATENT DOCUMENTS

| | | | |
|---|---|---|---|
| 3,938,335 | 2/1976 | Marwick | 60/649 X |
| 3,972,195 | 8/1976 | Hays et al. | 60/649 X |

*Primary Examiner*—Allen M. Ostrager

*Attorney, Agent, or Firm*—Clarence A. O'Brien; Harvey B. Jacobson

[57] ABSTRACT

Flow of gas in opposite directions through vertical conduits is accelerated by evaporation of heated liquid to decrease the density of the gas entering the lower inlet end of one of the conduits in an upflow direction. Extraction of the liquid vapor from the gas adjacent the upper outlet end of the upflow conduit further accelerates gas flow which is thermally induced by heat exchange between the gas and the heated liquid at the lower outlet end of the downflow conduit.

26 Claims, 6 Drawing Figures

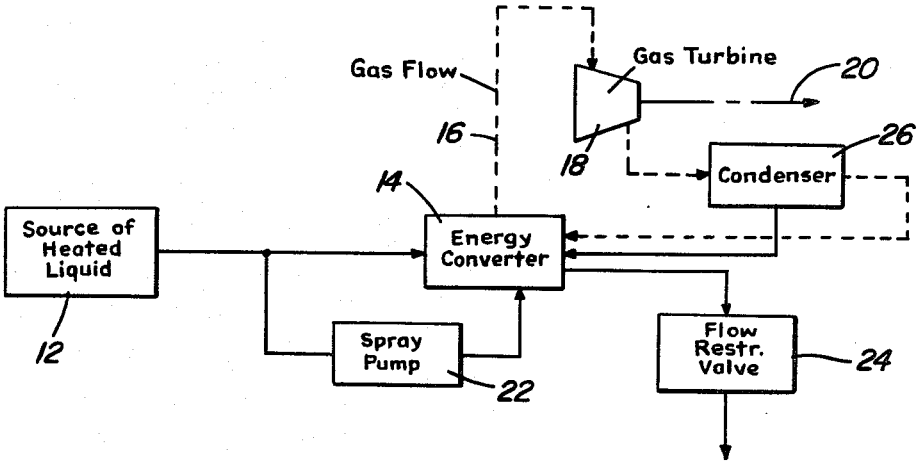

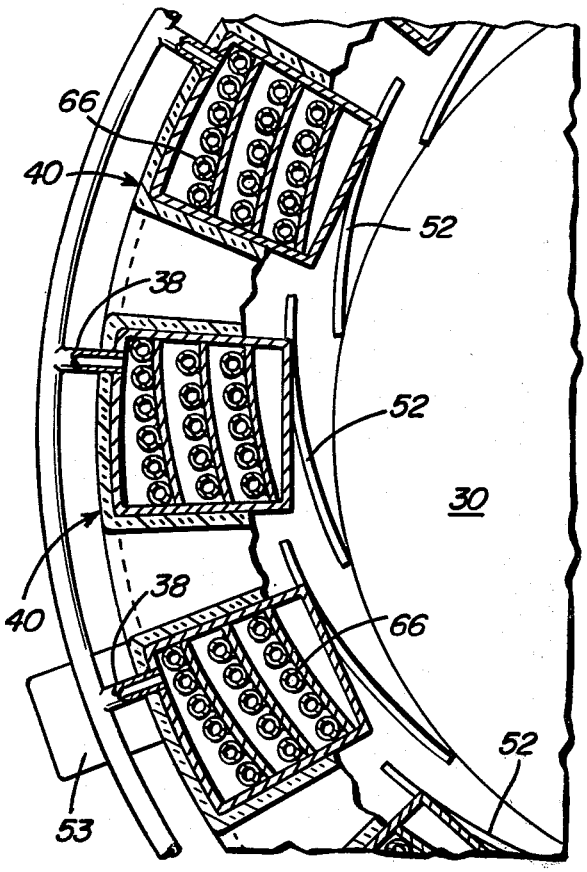
Fig. 3
Fig. 4
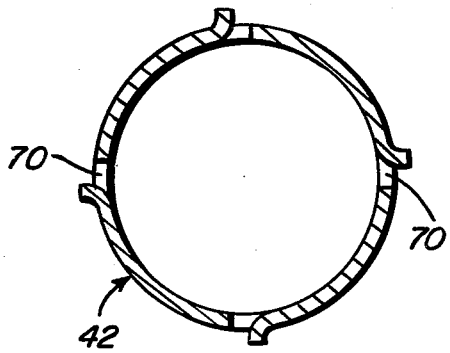
Fig. 5
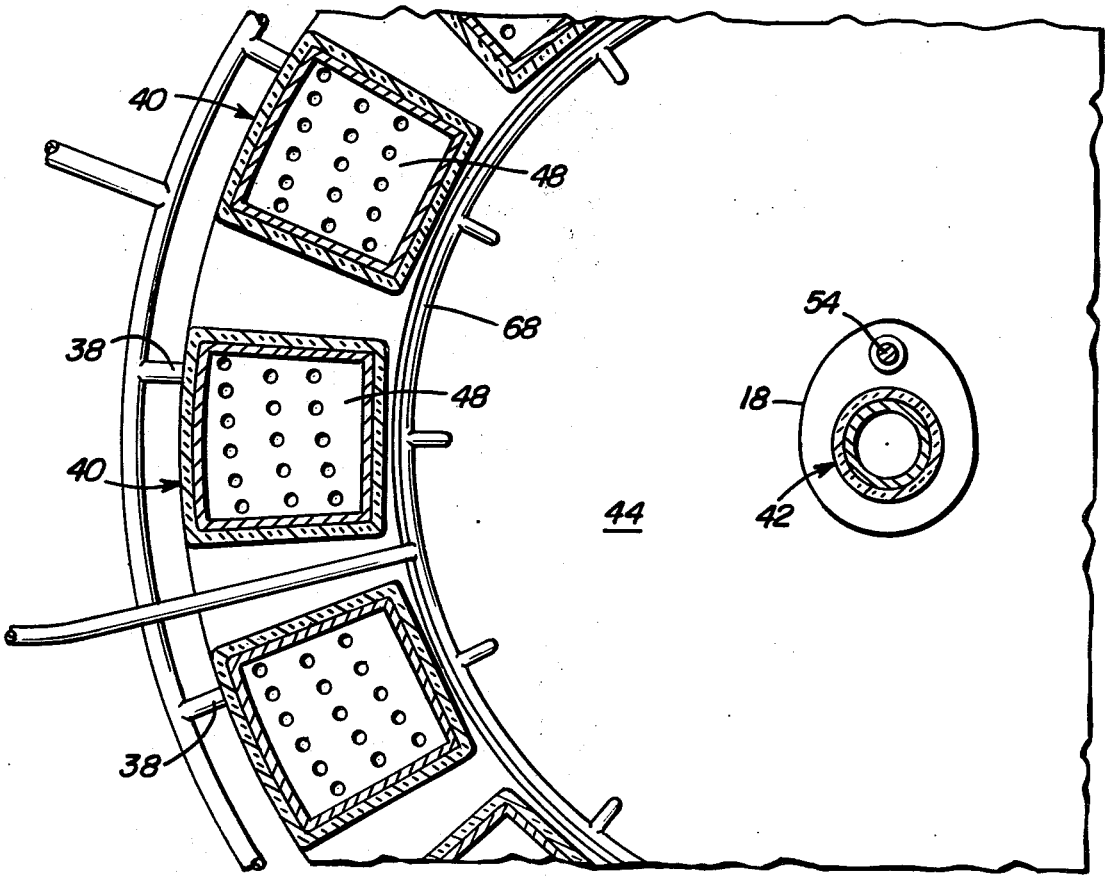

AIR-WATER POWER GENERATOR

BACKGROUND OF THE INVENTION

This invention relates to a method and apparatus for converting the heat energy in a body of heated liquid, such as water, into kinetic energy of a flowing gas, such as air, in order to drive a gas turbine or the like and for other purposes.

Various methods and apparatus have been devised for controlling the conversion of energy from one form to another by use of the diverse properties of different fluids including water and air as well as other liquids and gases in order to generate power. Prior U.S. patents disclosing such methods and apparatus of which applicant is presently aware, consist of U.S. Pat. Nos. 3,076,316, 3,490,906, 3,894,393, 4,022,024 and 4,027,483.

Such prior energy conversion methods and apparatus have been relatively inefficient and not feasible from an economic standpoint. It it therefore an important object of the present invention to provide an efficient method and apparatus for converting the heat energy in a body of liquid into kinetic energy of a flowing gas to generate motive power avoiding the drawbacks of prior art arrangements.

SUMMARY OF THE INVENTION

In accordance with the present invention, thermally induced flow of gas such as air which is adapted to drive a turbine is accelerated by an abrupt reduction in its density as it enters an upflow conduit. The gas density is decreased by introducing liquid vapor into the gas at a higher temperature. The gas flow is further accelerated by imparting vorticity to the gas at a lower inlet end of an upflow conduit and extracting the water vapor adjacent the upper outlet end of the conduit at a gravitationally higher level. The liquid condensate obtained by the extraction of the water vapor from the gas is recycled into the supply of heated liquid utilized to thermally induce flow of the gas by means of heat exchangers at the lower outlet ends of a downflow conduit conducting the cooler gas. The liquid which may be water is obtained from any source including sea water, in which case the present invention will be useful in converting the sea water into potable water as a byproduct benefit. Any suitable source of energy may be utilized to heat the water including fossil and non-fossil fuels as well as natural sources of heat, such as solar and geothermal sources.

These, together with other objects and advantages which will become subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is an enlarged partial sectional view taken substantially through a plane indicated by section line 3—3 in FIG. 2.

FIG. 4 is an enlarged partial sectional view taken substantially through a plane indicated by section line 4—4 in FIG. 2.

FIG. 5 is a partial sectional view taken substantially through a plane indicated by section line 5—5 in FIG. 2.

DETAILED DESCRIPTION OF PREFERRED EMBODIMENTS

Figure 1:
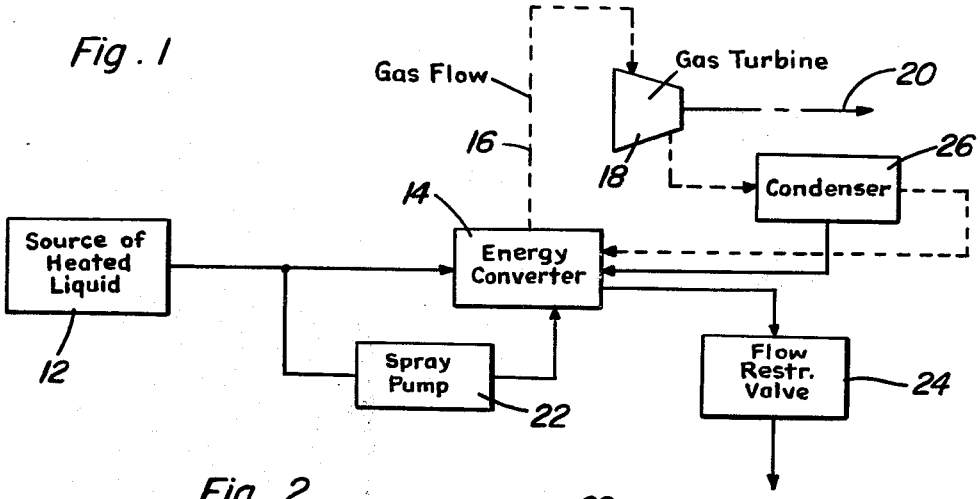
FIG. 1 is a block diagram schematically illustrating the system of the present invention.

Referring now to the drawings in detail, FIG. 1 schematically illustrates the system of the present invention generally denoted by reference numeral 10. A source of heated liquid generally referred to by reference numeral 12 is depicted in FIG. 1, which may include water heated by combustion of fossil or non-fossil fuels. Alternatively, the source of heated liquid may be coolant discharged from industrial processes, coolant from a nuclear power plant, solar heated sea water or geothermal fluid. The heated liquid is fed to an energy converter 14 within which the heat energy in the liquid is converted into the kinetic energy in a flowing gas stream 16 that is fed through a fluid motor such as gas turbine 18 in order to obtain a motive energy output at 20. Heated liquid may also be injected into the energy converter 14 in the form of a liquid spray by means of a spray pump 22. As will be explained in detail hereinafter, a predetermined body of fluid is maintained in a substantially static condition within the energy converter by regulating outflow of liquid from the energy converter through a flow-restricter valve assembly 24. A certain portion of the liquid is evaporated within the energy converter, the liquid vapor being entrained with the gas in the gas flow stream 16 fed to the turbine 18. The gas discharged from the turbine is then conducted through condenser 26 by means of which the liquid vapor is extracted from the gas before the gas is recycled through the energy converter. The liquid condensate from condenser 26 is also recycled as depicted in FIG. 1.

Figure 2:
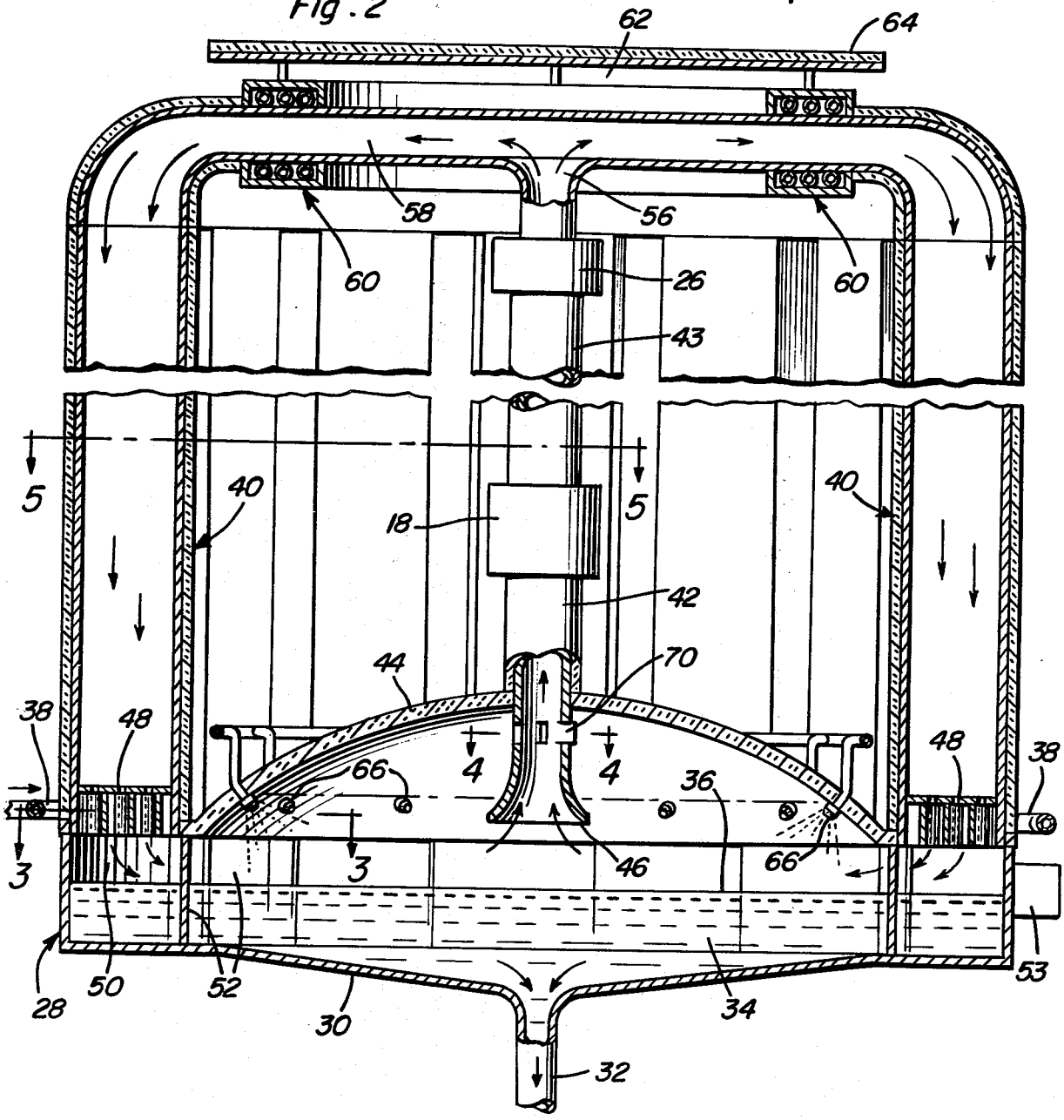
FIG. 2 is a side sectional view of apparatus constructed in accordance with one embodiment of the present invention.

FIGS. 2, 3 and 5 illustrate one form of energy converter 14 with which the gas turbine 18 and condenser 26 are associated. The converter apparatus includes a bottom liquid collection tank generally referred to by reference numeral 28 having a downwardly converging bottom wall 30 to which a centrally located outlet conduit 32 is connected. A body of liquid 34 of substantially constant volume is maintained within the tank 28 in order to establish a substantially static liquid evaporation surface 36. Accordingly, the outflow of liquid through outlet conduit 32 is regulated by the flow restriction valve 24 aforementioned in order to match the inflow of liquid to the tank 28 from a plurality of circumferentially spaced inlet conduits 38. The inlet conduits are located in spaced relation above the surface 36 of the liquid body 34 in alignment with the lower outlet ends of a plurality of vertical downflow conduits generally referred to by reference numeral 40, which are circumferentially spaced about a central upflow conduit generally referred to by reference numeral 42. The conduits 40 and 42 are insulated to reduce heat transfer. Further, a heat insulation barrier 44 interconnects the lower outlet ends of the downflow conduits 40 with the central upflow conduit 42 in vertically spaced relation above the lower inlet end portion 46 of the upflow conduit 42. The inlet end portion 46 of the upflow conduit as shown in FIG. 2 has a convergent flow area in order to effect acceleration of flow by volumetric contraction of the upflowing fluid. The lower outlet ends of the downflow conduits 40, on the other hand, have heat exchangers 48 located therein through which the heated liquid entering through inlet conduits 38 is conducted in heat transfer relationship to the gas being conducted in a downflow direction through the downflow conduits 40. The gas and liquid discharged from the heat exchangers 48, enter the bottom collection tank 28 by passage through an annular flow directing chamber 50 within which flow directing vanes 52 are located to induce vortical flow. Booster pumps 53 are mounted on the periphery of tank 28 through which circumferential flow of fluid is maintained at a desired rate by inflow and outflow at the periphery.

According to one embodiment of the invention upward gas flow through the central upflow conduit 42 is conducted through gas turbine 18 by means of which the kinetic energy of the gas is converted into motive energy of a drive shaft 54 as shown in FIG. 5. The gas discharged from the turbine 18 is then conducted in an upward direction by an extension 43 of the upflow conduit 42. Adjacent the upper outlet end of the upflow conduit, the liquid vapor is extracted by means of a condenser 26 before the vapor-free gas enters an outlet transition zone 56 as shown in FIG. 2. The turbine 18 and condenser 26 schematically shown in FIGS. 2 and 5, are well known pieces of equipment, the details of which form no part of the present invention.

The vapor-free gas in the outlet transition zone 56 as shown in FIG. 2, is recycled by passage through expansion and cooling zone 58 before returning to the upper inlet ends of the downflow conduits 40. To increase the gas density within the expansion zone 58, a gas cooler device 60 is mounted in operative relation to the expansion zone within a heat exchange area 62 that is protectively enclosed by a thermal insulation barrier 64 at the top of the converter apparatus 14.

As more clearly seen in FIGS. 2 and 3, each of the heat exchangers 48 includes a plurality of heat transfer tubes 66 through which the downflowing gas is conducted in heat exchange relation to the heated liquid entering the apparatus through the inlet conduits 38. The liquid and gas discharged from the heat exchangers 48 then enter the flow-directing chamber 50 within which a vortical flow component is imparted thereto by means of the fixed vanes 52 disposed at a predetermined angle to the inflowing liquid and gas. The liquid entering the collection bank 28 will maintain the body of liquid 34 volumetrically constant as aforementioned while the gas passes in contact with the surface 36 in order to effect evaporation of the liquid. In view of the heating of the gas within the heat exchangers 48, a pressure differential is established in order to thermally induce flow in opposite directions through the vertical conduits 40 and 42. The vortical components imparted to the gas flow by the vanes 52 will enhance evaporation of the liquid. The rate of evaporation of the liquid is furthermore increased by injecting the liquid in spray form through the atomizing spray nozzles 66 mounted on the thermal barrier 44 above the body of liquid 34 as shown in FIG. 2. Heated water is accordingly supplied to the nozzles 66 through an annular manifold 68 as shown in FIG. 5. The manifold 68 is connected to the spray pump 22 aforementioned in connection with FIG. 1.

The thermally induced flow of gas as it passes between the lower ends of the downflow conduits and the upflow conduit 42, is abruptly decreased in density by virtue of the evaporation of the liquid from surface 36 resulting in a buoyancy accelerating force being exerted on the gas entering the upflow conduit 42. The kinetic energy of the upflowing gas is further increased by its vorticity. Entraining slots 70 are formed in the upflow conduit 42 above the convergent inlet end 46 in order to improve circulation as shown in FIGS. 2 and 4.

It will be apparent from the foregoing description of FIGS. 1–5 that an efficient arrangement is provided for thermally inducing flow of a gas such as air by location of the heat exchangers 48 at the lower outlet ends of the downflow conduits 40 just above the flow directing chambers 50 through which vortical flow components are imparted to the gas in order to increase its vorticity and enhance evaporation of the liquid. The decrease in density of the gas resulting from the evaporation of the liquid and entrainment of liquid vapor therein is an additional factor in accelerating upflow of the gas through the central upflow conduit 42. Extraction of the liquid vapor by the condenser 26 at a gravitationally higher level than the body of liquid 34, further accelerates the gas flow which is recycled through expansion and cooling zone 58 in the embodiment illustrated in FIG. 2.

Figure 6:
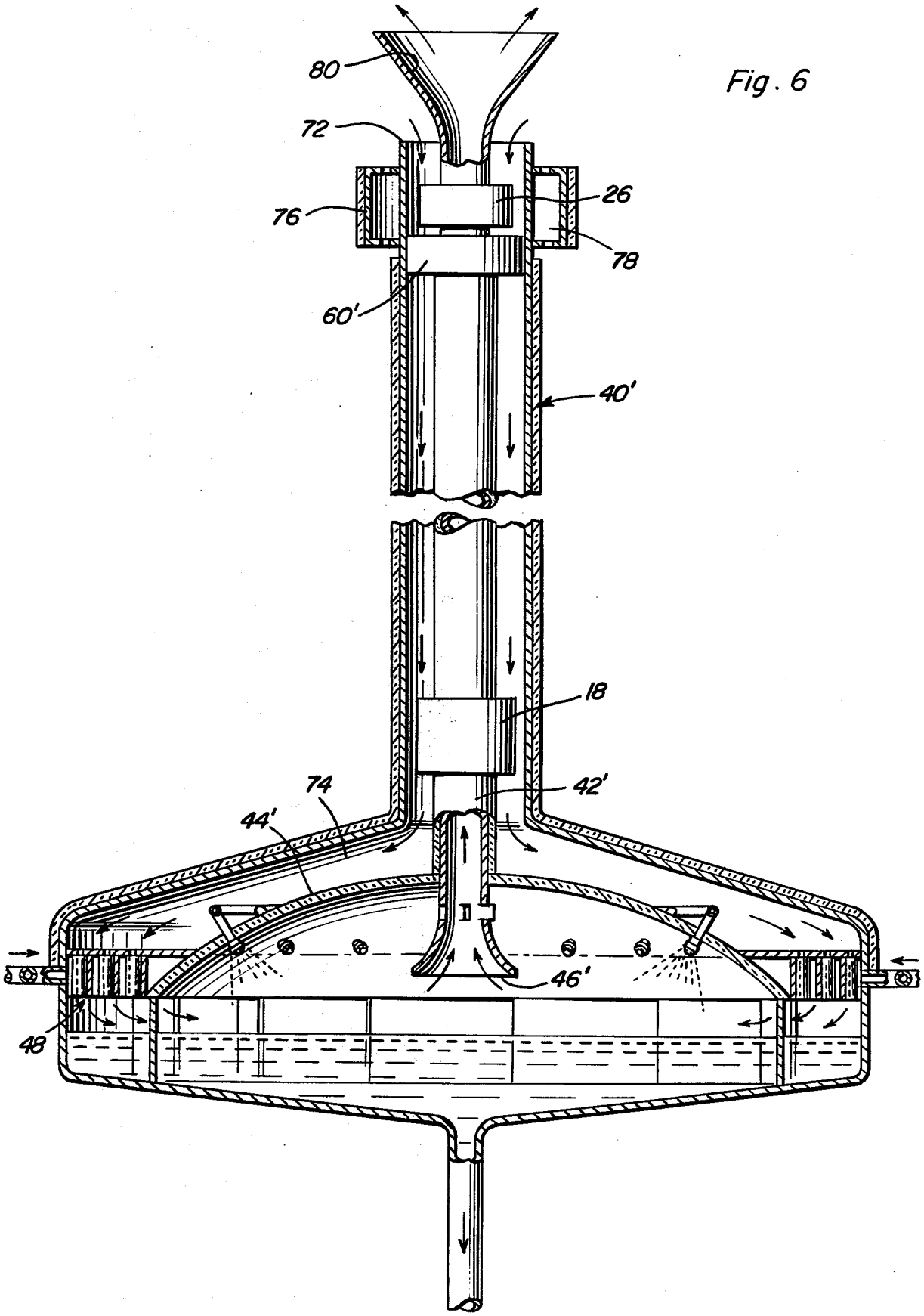
FIG. 6 is a side sectional view through another form of apparatus constructed in accordance with another embodiment of the present invention.

A modified form of apparatus generally referred to by reference numeral 14' is shown in FIG. 6. While the apparatus 14 shown in FIG. 2 is of the closed loop type wherein the air is recycled, the apparatus 14' is of the open loop type in which there is no recycling of the air. Further, the apparatus 14' includes a single downflow conduit 40' mounted in coaxial relationship to the central upflow conduit 42' with which the turbine 18 and condenser 26 are associated. Thus, a downflow of ambient air entering the upper inlet end 72 of the downflow conduit 40, passes in heat insulated relationship to the gas within the upflow conduit 42' before entering into the heat exchangers 48 through the insulated passage 74 located above the thermal insulation barrier 44'. The cooler downflowing air is accordingly heated by the liquid within the heat exchangers 48 and directed into contact with the body of liquid for evaporation thereof as hereinbefore described with respect to FIG. 2. A less dense gas with water vapor entrained therein is accordingly conducted into the upflow conduit 42' through the converging inlet 46' as shown in FIG. 6. A gas cooling unit 60' is mounted about the central upflow conduit 42' just below the condenser 26 within the downflow conduit 40' adjacent the upper inlet end 72 which is furthermore enclosed by a thermal barrier 76 in order to establish a heat exchange zone 78 through which heat from the cooler unit 60' is removed. After the liquid vapor is extracted from the gas by condenser 26, it is then discharged to atmosphere through an upper divergent outlet end 80 of the upflow conduit 42'. The apparatus 14' is otherwise the same in construction and operation to the apparatus 14 hereinbefore described with respect to FIG. 2. to FIG. 2.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A method of converting heat energy in a liquid into kinetic energy of a gas, including the steps of: conducting said gas in heat exchange relation to the liquid to produce thermally induced flow of the gas; passing the flowing gas in contact with the liquid to effect evaporation of the liquid and entrainment of liquid vapor in the gas decreasing the density thereof; and directing the flow of said gas with the liquid vapor entrained therein in a direction enabling acceleration thereof as a function of said decrease in density of the gas.

2. The method of claim 1 including the step of: extracting the liquid vapor from the flow stream of the gas at a gravitationally higher level than the liquid prior to evaporation to further accelerate the flow of gas.

3. The method of claim 2 including the step of: volumetrically contracting the flowing gas with the liquid vapor entrained therein to still further accelerate the flow of gas.

4. The method of claim 3 including the step of: imparting a vortical flow component to the gas prior to contact with the liquid to increase the rate of evaporation of the liquid and the kinetic energy of the gas.

5. The method of claim 4 including the step of: collecting the liquid within a volumetrically enlarged zone to establish a substantially static liquid evaporation surface in contact with the gas.

6. The method of claim 5 including the step of: supplying the liquid to said zone after heat exchange with the gas.

7. The method of claim 1 including the step of: volumetrically contracting the flowing gas with the liquid vapor entrained therein to still further accelerate the flow of gas.

8. The method of claim 1 including the step of: imparting a vortical flow component to the gas prior to contact with the liquid to increase the rate of evaporation of the liquid and the kinetic energy of gas.

9. The method of claim 1 including the step of: collecting the liquid within a volumetrically enlarged zone to establish a substantially static liquid evaporation surface in contact with the gas.

10. The method of claim 9 including the step of: supplying the liquid to said zone after heat exchange with the gas.

11. A method of converting heat energy in a liquid into kinetic energy of a gas, including the steps of: conducting said gas in heat exchange relation to the liquid to produce thermally induced flow of the gas; passing the flowing gas in contact with the liquid to effect evaporation of the liquid and entrainment of liquid vapor in the gas decreasing the density thereof; and extracting the liquid vapor from the flow stream of the gas at a gravitationally higher level than the liquid prior to evaporation to further accelerate the flow of gas.

12. The method of claim 11 including the step of: recycling the liquid condensate obtained as a result of said extraction of the liquid vapor from the gas.

13. A method of converting heat energy in a liquid into kinetic energy of a gas, including the steps of: conducting said gas in heat exchange relation to the liquid to produce thermally induced flow of the gas; collecting the liquid within a volumetrically enlarged zone to establish a substantially static liquid evaporation surface; passing the gas in contact with said liquid evaporation surface to effect evaporation of the liquid to decrease the density of the gas; and accelerating the flow of the gas as a function of said decrease in density thereof.

14. The method of claim 13 including the step of: imparting a vortical flow component to the gas prior to contact with the liquid to increase the rate of evaporation of the liquid and the kinetic energy of the gas.

15. The method of claim 1 wherein said liquid is water and said gas is air.

16. In combination with a source of heated liquid, apparatus for converting the heat energy in the liquid into kinetic energy of a gas, including at least two vertically elongated conduits through which the gas is conducted in opposite directions, heat exchange means conducting the heated liquid from said source in heat transfer relation to the gas for producing thermally induced flow of the gas through said conduits, means collecting a body of the liquid discharged from the heat exchange means for establishing a liquid evaporation surface, and means directing flow of the gas between said conduits into contact with said liquid evaporation surface for effecting evaporation of the liquid and a decrease in density of the gas, whereby the thermally induced flow of said gas is accelerated as a function of said decrease in density.

17. The combination of claim 16 including fluid motor means driven by said flow of gas in one of the conduits and condenser means for extracting liquid vapor from the gas upstream from the fluid motor means above the liquid evaporation surface to further accelerate the flow of gas.

18. The combination of claim 17 wherein said flow directing means includes vane means for imparting vortical flow components to the gas and the liquid discharged from the heat exchange means to enhance evaporation of the liquid and increase the kinetic energy of the gas entering said one of the conduits.

19. The combination of claim 18 wherein the other of the conduits conducts the gas in a downflow direction into the heat exchange means.

20. The combination of claim 16 including means for extracting liquid vapor from the gas during upflow through one of the conduits above the liquid evaporation surface to further accelerate the flow of gas.

21. The combination of claim 20 wherein the other of the conduits conducts the gas in a downflow direction into the heat exchange means.

22. The combination of claim 21 including means for recycling the gas between said conduits.

23. The combination of claim 22 wherein the other of the conduits is mounted in coaxial relation to said one of the conduits.

24. The combination of claim 16 wherein said flow directing means includes vane means for imparting vortical flow components to the gas and the liquid discharged from the heat exchange means to enhance evaporation of the liquid and increase the kinetic energy of the gas entering one of the conduits.

25. In combination with a source of heated liquid, apparatus for converting the heat energy in the liquid into kinetic energy of a gas, including at least two vertically elongated conduits, means for thermally inducing flow of the gas through said conduits, liquid evaporating means for passing the gas in contact with the liquid during flow between the conduits to decrease the density of the gas conducted upwardly through one of the conduits, and means for extracting liquid vapor from the gas in said one of the conduits upstream of the liquid evaporating means to accelerate said thermally induced flow of the gas.

26. The combination of claim 25 including means for imparting vortical flow components to the gas entering the liquid evaporating means to enhance evaporation of the liquid.

* * * * *